US012137799B2

(12) United States Patent
Horton

(10) Patent No.: US 12,137,799 B2
(45) Date of Patent: Nov. 12, 2024

(54) BRUSH EASY

(71) Applicant: Ykesha Horton, Chicago, IL (US)

(72) Inventor: Ykesha Horton, Chicago, IL (US)

(73) Assignee: Ykesha Horton, Chicago, IL (US)

( * ) Notice: Subject to any disclaimer, the term of this patent is extended or adjusted under 35 U.S.C. 154(b) by 336 days.

(21) Appl. No.: 17/009,861

(22) Filed: Oct. 1, 2020

(65) Prior Publication Data

US 2022/0061512 A1 Mar. 3, 2022

(51) Int. Cl.

| | |
|---|---|
| ***A46B 5/00*** | (2006.01) |
| ***A46B 11/00*** | (2006.01) |
| ***A46B 17/00*** | (2006.01) |

(52) U.S. Cl.

CPC ..... *A46B 5/0095* (2013.01); *A46B 11/0003* (2013.01); *A46B 11/0065* (2013.01); *A46B 17/00* (2013.01); *A46B 2200/304* (2013.01)

(58) Field of Classification Search

CPC ..... A46B 5/0095; A46B 11/0003; A46B 11/0065; A46B 17/00; A46B 2200/304

USPC ..... 15/143.1, 145

See application file for complete search history.

(56) References Cited

U.S. PATENT DOCUMENTS

| | | | | | |
|---|---|---|---|---|---|
| 2,673,998 | A * | 4/1954 | Swartz | A46B 11/001 | 401/268 |
| 5,207,754 | A * | 5/1993 | Harrah | A46B 5/0095 | 15/147.1 |
| 8,360,668 | B1 * | 1/2013 | Hinnant | A46B 5/0075 | 401/6 |
| 2004/0010877 | A1 * | 1/2004 | Jackson | A46B 7/04 | 15/210.1 |
| 2004/0141794 | A1 * | 7/2004 | Slaboden | A47K 11/10 | 401/268 |
| 2009/0285621 | A1 * | 11/2009 | Samartgis | A46B 11/0013 | 401/196 |
| 2014/0311524 | A1 * | 10/2014 | Call | A46B 7/04 | 15/104.94 |
| 2016/0029859 | A1 * | 2/2016 | Harrington | A47K 11/10 | 15/143.1 |

* cited by examiner

*Primary Examiner* — William V Gilbert

(57) ABSTRACT

A transparent toilet brush container of three circles stacked one on the other. A crystal transparent handle, followed by a flat surface on the bottom of the handle that sits on top of the container. A button is attached to each side of the toilet brush stick for the user to press to eject the brush head. The soap/air freshener-like substance sits in the middle of the bristles on the toilet brush. Once the user inserts the brush head in water the dense substances produce soap.

1 Claim, 6 Drawing Sheets

BRUSH EASY

DETAILED DESCRIPTION

FIG. 1. A. This is a front-side view of a toilet brush seated Inside the base. Next, FIG. 2; is a top-side view of a toilet brush. FIG. 2. B is the transparent handle of a toilet brush. The flat surface in FIG. 2. C is the flat surface connected to the crystal handle of a toilet brush. It will sit on the container's base. FIGS. 2D and E are the two buttons to eject the head. FIG. 3 is a side view of a toilet brush, and FIG. 3H is the opening for the connector. FIGS. 3, F and G are the connectors to FIG. 3H of the toilet brush head. FIG. 4.) is a dense substance that sits inside the bristles in FIG. 4. K, in a U-shape around the dense substance. FIG. 5 is a side view of the brush head and dense substance. The dense substance in FIG. 5, L can be removed from FIG. 5, M as shown. When immersed in water, it acts as a disinfectant and a cleaning agent. FIG. 6, N the dense substances sit inside the toilet brush head.

DESCRIPTION OF RELATED ART

"Brush Easy" is a new type of toilet brush that features transparent colors and built-in soap in the brush head. In addition, the brush head is ejectable. An air freshener-like substance is present in the center of the bristles of the toilet brush. Immersing the brush head in water activates the dense substance, which produces soap. To maintain sanitation, users can change the "Brush Easy" brush head without touching it by pressing the button to eject the head.

BRIEF DESCRIPTION

FIG. 1 is the front view of "Brush Easy." FIG. 1A, is the transparent container and toilet brush.

FIG. 2 is a top-side view of the brush and handle of "Brush Easy." FIG. 2B is the transparent handle. FIG. 2C shows the flat surface that sits on the transparent container. FIGS. 2D and E are two buttons to eject the brush head.

FIG. 3H is the opening to connect FIGS. 3F and G are the connectors to connect the body of the toilet brush.

FIG. 4J is the dense substance that will sit inside of FIG. 4K.

FIG. 4K are the bristles that are formed in a U shape that would sit around FIG. 4J.

FIG. 5L the dense substance is shown outside the bristles in FIG. 5M, this dense substance FIG. 5L can be replaced/changed.

Figure 1:
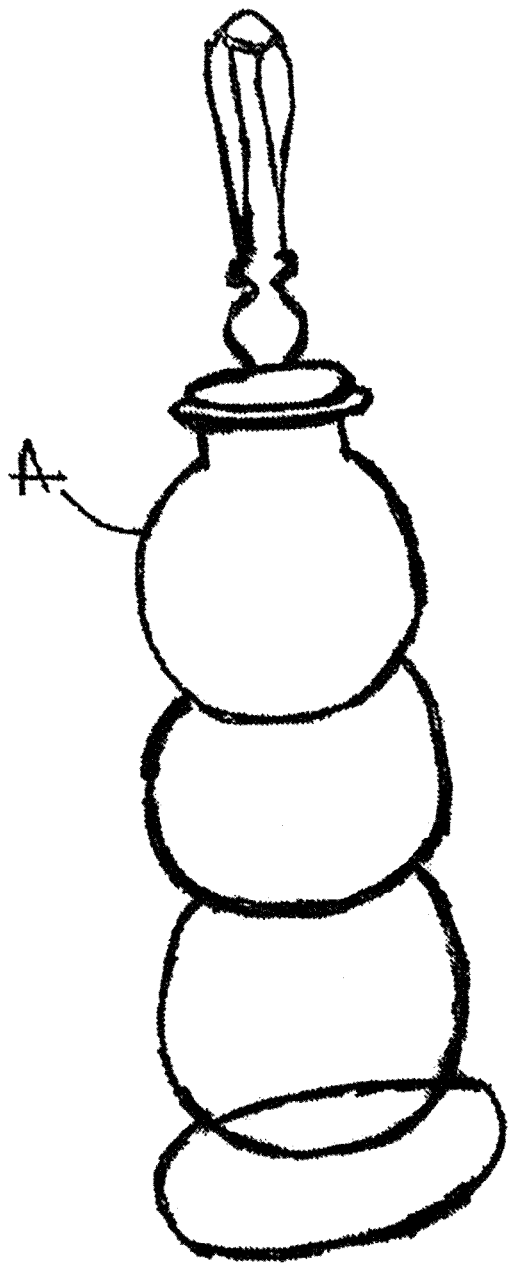
Figure 2:
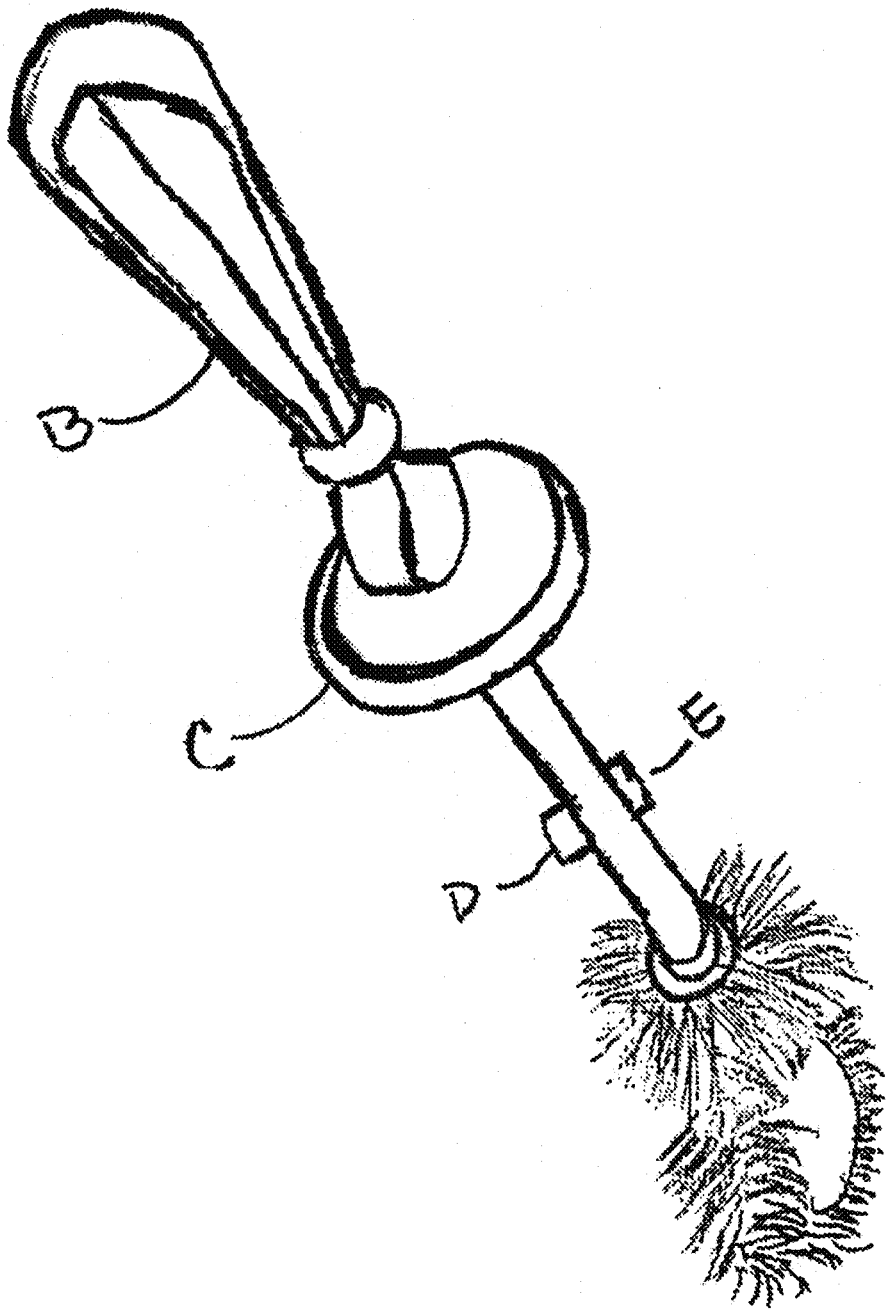
Figure 3:
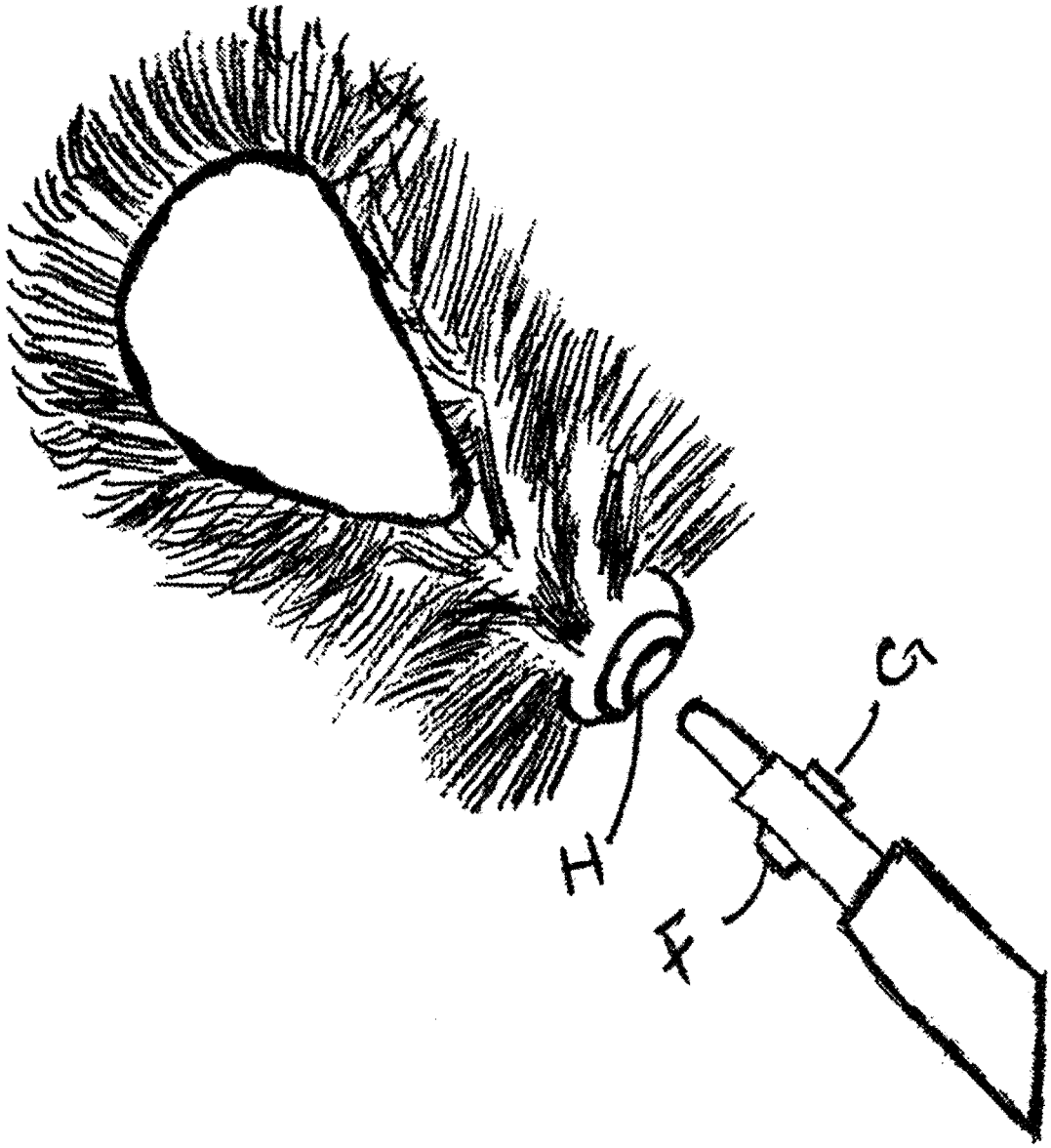
FIG. 3 is a side view of the brush handle.
Figure 4:
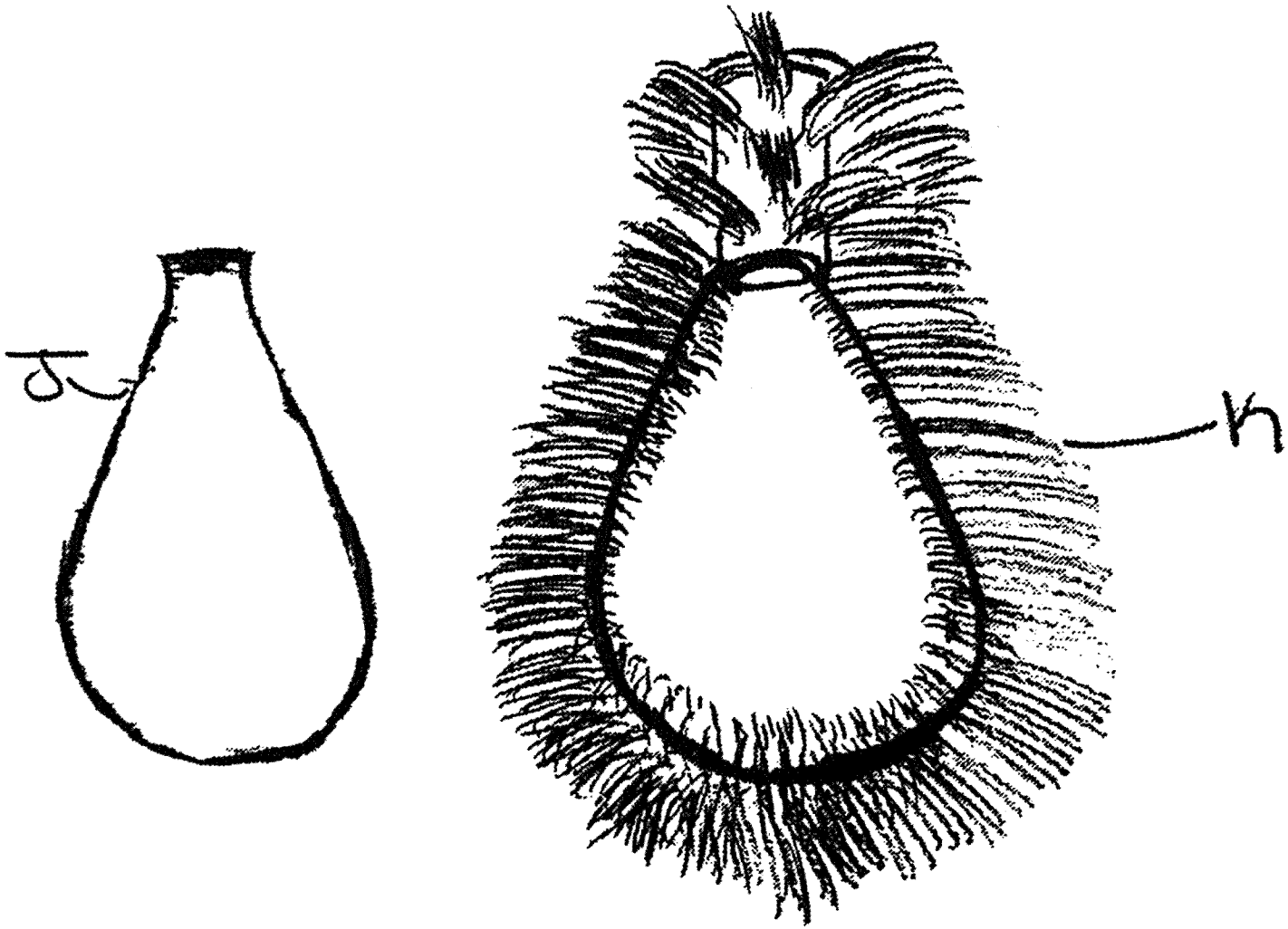
FIG. 4 is a front view of the brush head.
Figure 5:
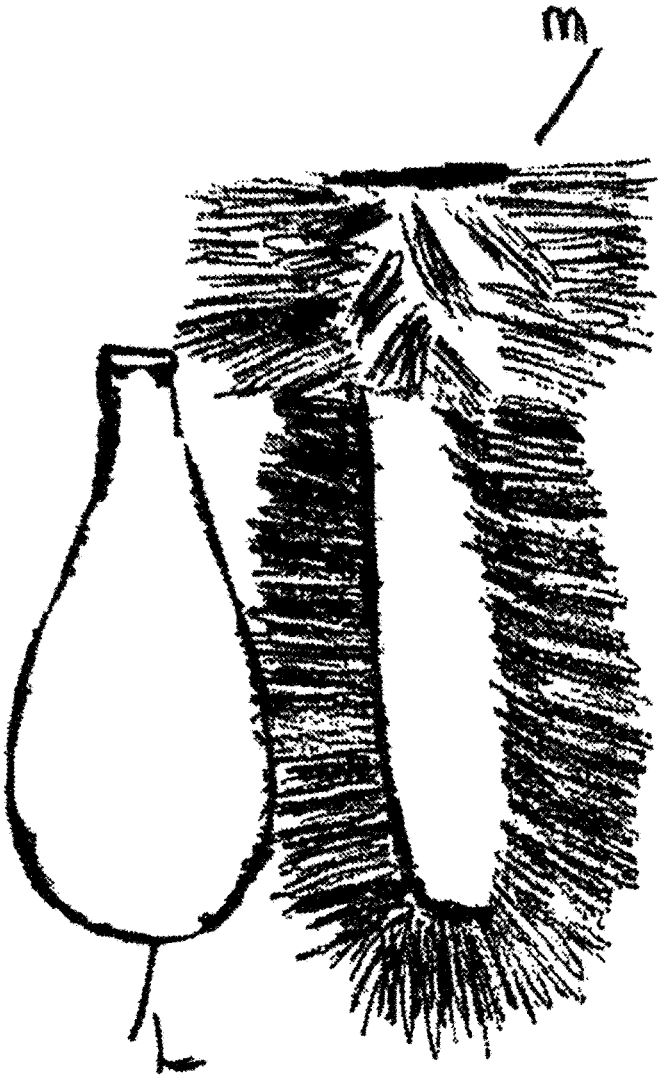
FIG. 5 is a side view of the brush head.
Figure 6:
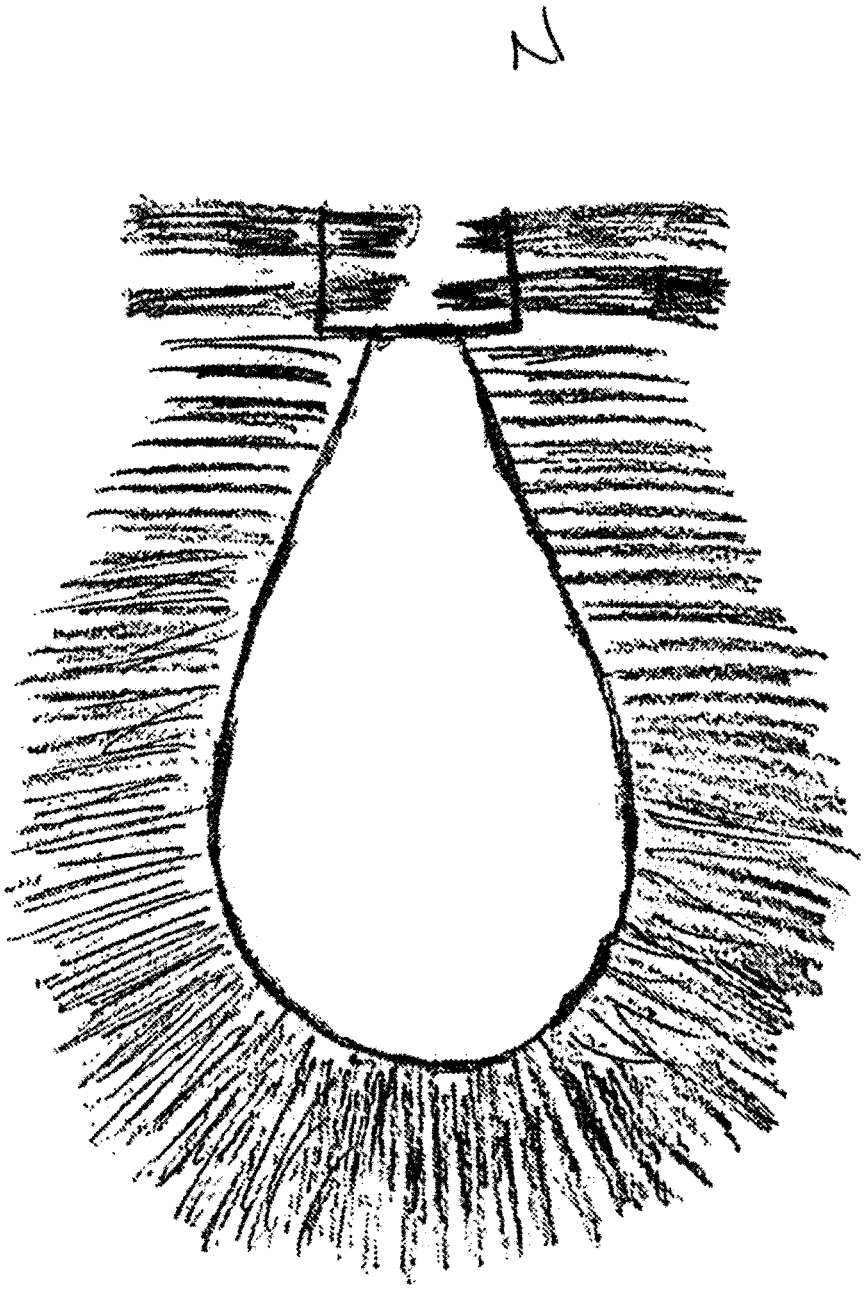
FIG. 6N is a front view of the brush head followed by the dense substance sitting in the middle of the bristles of the toilet brush. 2

I claim:

1. A toilet brush and a container, comprising;

said container being transparent and made from plastic and configured to receive and contain said toilet brush;

said toilet brush comprising:

a transparent plastic handle;

a shaft extending from said handle, said shaft having a first end and a second end opposite said first end, said handle being attached to said first end;

a flat surface extending substantially perpendicular with respect to a longitudinal axis of said shaft, said flat surface being proximate said first end of said shaft and configured to rest on a top of said transparent container;

a first button and a second button each located between said first end and said second end;

an ejectable brush head attached to said second end and configured to be ejected from said second end upon pressing said buttons, said brush head being in a shape forming a loop;

a hard soap substance being received and retained in said loop.

* * * * *